United States Patent [19]

Massino

[11] 4,241,918

[45] Dec. 30, 1980

[54] LIGHTER AND SOFTER RECREATIONAL BALLS

[76] Inventor: Chester F. Massino, 43 Golf Ct., Sandwich, Ill. 60548

[21] Appl. No.: 29,316

[22] Filed: Apr. 12, 1979

[51] Int. Cl.[3] ..... A63B 41/00

[52] U.S. Cl. ..... 273/65 E; 273/58 A; 273/DIG. 9; 428/76

[58] Field of Search ..... 428/68, 74, 76; 273/65 R, 65 E, 65 EC, 65 EE, 65 EG, DIG. 9, 58 A

[56] References Cited

U.S. PATENT DOCUMENTS

| | | | |
|---|---|---|---|
| 1,277,368 | 9/1918 | Blocksom | 273/65 E |
| 1,597,308 | 8/1926 | Brandt | 273/65 EC |
| 1,754,937 | 4/1930 | Comstock | 273/65 E |
| 2,653,818 | 9/1953 | Tebbetts, Jr. et al. | 273/65 EG |
| 3,884,466 | 5/1975 | MacDonald et al. | 273/65 EC |

FOREIGN PATENT DOCUMENTS

| | | | |
|---|---|---|---|
| 629797 | 10/1961 | Canada | 273/65 E |
| 2125758 | 12/1972 | Fed. Rep. of Germany | 273/65 R |
| 847885 | 9/1960 | United Kingdom | 273/65 E |

*Primary Examiner*—George F. Lesmes
*Assistant Examiner*—E. Rollins Buffalow
*Attorney, Agent, or Firm*—Leydig, Voit, Osann, Mayer & Holt, Ltd.

[57] ABSTRACT

A ball having the general appearance, shape and aerodynamic characteristics of a conventional football when thrown or kicked; but which is softer and lighter allowing for its use in congested areas—it does not travel as far when thrown or kicked—and by younger children who are more susceptible to injury with a conventional football. The ball is comprised of a polyester batting interior or center having a wool batting inner cover and a polyester double-knit outer cover. The ball preferably has "cross stitching" prepared from a textile paint to give an elevated or raised ridge for gripping the ball thereby enhancing its throwing characteristics.

3 Claims, 7 Drawing Figures

FIG. 4
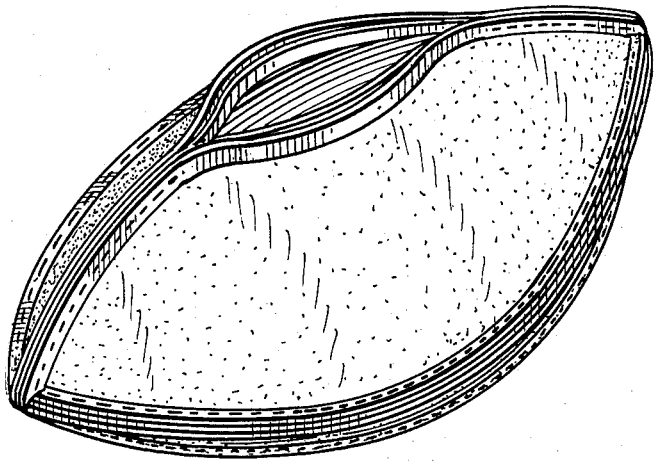
FIG. 5
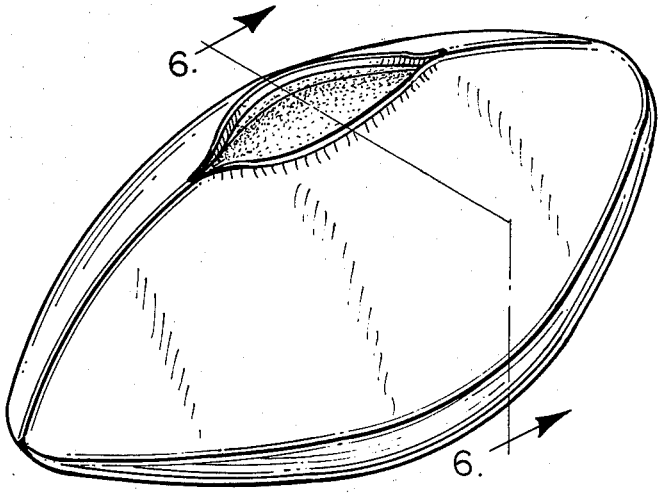
FIG. 6
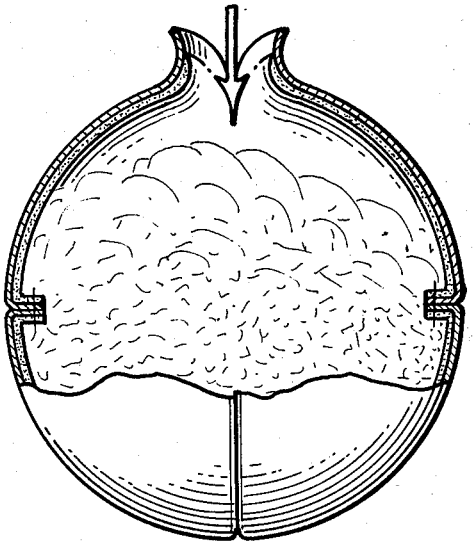
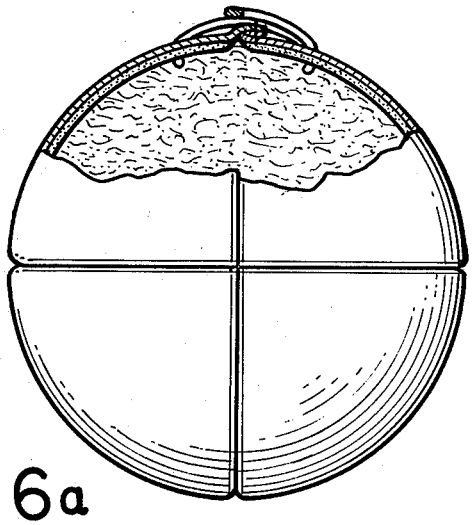
FIG. 6a

LIGHTER AND SOFTER RECREATIONAL BALLS

BACKGROUND OF THE INVENTION

This invention relates to a ball, more particularly to a ball which can be substituted for a conventional football where space is limited, where the players are more susceptible to injury by the use of a hard ball such as a football or where the surrounding property is susceptible to damage, e.g., windows.

A conventional football has a relatively hard form and is potentially injurious to young children just learning to play the game as well as being difficult for them to grip. The need for a lighter, softer and potentially less dangerous ball has long been recognized by the sporting industry. Various alternatives such as balls made of polyurethane foam, plastic of the like have been manufactured but have met with only limited success. While these lightweight balls have been used, they have not had a great degree of success because the characteristics of these substitutes have been substantially different from the conventional football, i.e., they are not capable of being thrown in such a way as to result in a spiral and accordingly the aerodynamic characteristics of a conventional football have not been obtained by these substitutes.

A lighter, softer and less dangerous ball which would still have the characteristics of a conventional football then would be of substantial benefit to the sporting public for the following reasons:

1. The technical skills required to play the game well would still be required;
2. The playing field size could be reduced substantially since the ball could not be thrown or kicked as far; and
3. There would be less danger to the participants and to the surrounding property. This would be of particular benefit to young children just beginning to play the game.

The subject invention is directed to such a ball and a method of making it.

SUMMARY OF THE INVENTION

According to the invention a ball noticeably lighter and softer than a football but having the general appearance, shape and characteristics of a football (particularly the aerodynamic characteristics) is provided. The ball is comprised of (1) a polyester batting fill interior or center portion which has been covered with (2) a four-piece wool batting inner cover which assists in maintaining the proper shape, and which is made of four identical pieces which have been stitched together and which has in turn been covered with (3) a polyester doubleknit four-piece outer cover stitched in place. Preferably, cross-stitch seams are provided on the ball by the use of a textile paint to provide an elevated or raised ridge for gripping of the ball to enhance the aerodynamics of the ball when thrown, i.e., to allow a spiral to be thrown.

BRIEF DESCRIPTION OF THE DRAWING

FIG. 4 is a view of the ball cover including the polyester doubleknit exterior and the wool batting inner cover but turned inside out prior to the stuffing of the ball with the polyester batting fill.

FIG. 5 is an exterior view of the ball showing the opening through which the polyester batting fill is stuffed and which will then be closed and to which raised cross-stitching will be applied.

FIG. 6 is a cross-sectional view of the ball showing the securing of the seams of the cover and inner wool batting and the hole through which the polyester batting fill is inserted.

FIG. **6*a*** is a view of one alternative method of providing stitching by which the hole, through which the polyester batting fill is inserted, is closed and also providing the raised stitching necessary for throwing a spiral with the ball.

DETAILED DESCRIPTION OF THE INVENTION

The present invention is predicated on the discovery that by the proper selection of materials and the proper manufacturing technique, a ball having the general appearance, shape and characteristics of a football can be produced. However, the ball of the subject invention requires less space—a smaller field—in which to play since the ball does not travel as far when kicked or thrown. Additionally, there is less danger to limb and property since the ball is softer and lighter reducing the likelihood of broken windows and damage to individuals struck by the ball.

Figure 3:
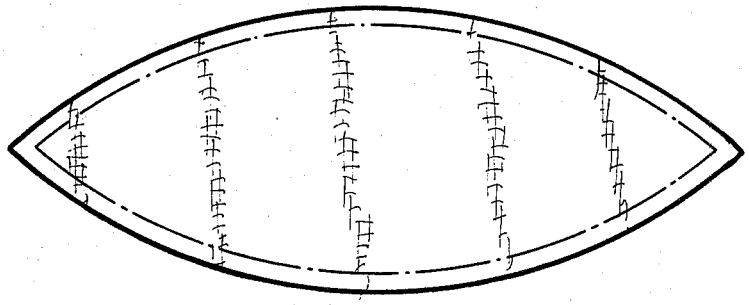
FIG. 3 is a view of one of the four pieces used to prepare the polyester double-knit outer cover. Substantially identical pieces in shape—the size may be slightly smaller—are used for the wool batting inner cover.

According to the invention and referring to the drawings, four sections having the general configuration (elliptical shape) shown in FIG. 3 are prepared out of doubleknit polyester. Correspondingly shaped pieces, but which may have a slightly smaller size, are prepared from a wool batting material. These pieces are then stitched together with the wool batting on the outside in the manner shown in FIG. 4 leaving a hole two or three inches long along one seam (as shown in FIG. 4) through which the polyester batting fill can subsequently be inserted. After the stitching of all four seams is completed—three completely and one as shown in FIG. 4 leaving a two to three inch hole along one seam—the ball cover is turned right side out so that the polyester double-knit cover is in its proper position, i.e., as the outside cover of the ball.

Polyester batting is then inserted through the hole left in the ball cover in an amount of from 3 to 4 ounces, preferably about $3\frac{3}{4}$ ounces. Preferably the polyester batting material is 100% polyester untreated extruded fiber having a denier of from about 4.5 to about 5.0 and preferably about 4.75. The amount of polyester batting used and the density with which the ball is packed will determine both the hardness of the ball and its weight. Obviously, the size of the ball will be determined by the size of the pieces used for the cover and the wool batting. A junior sized ball can be prepared if desired using the general technique set out herein.

Figure 1:
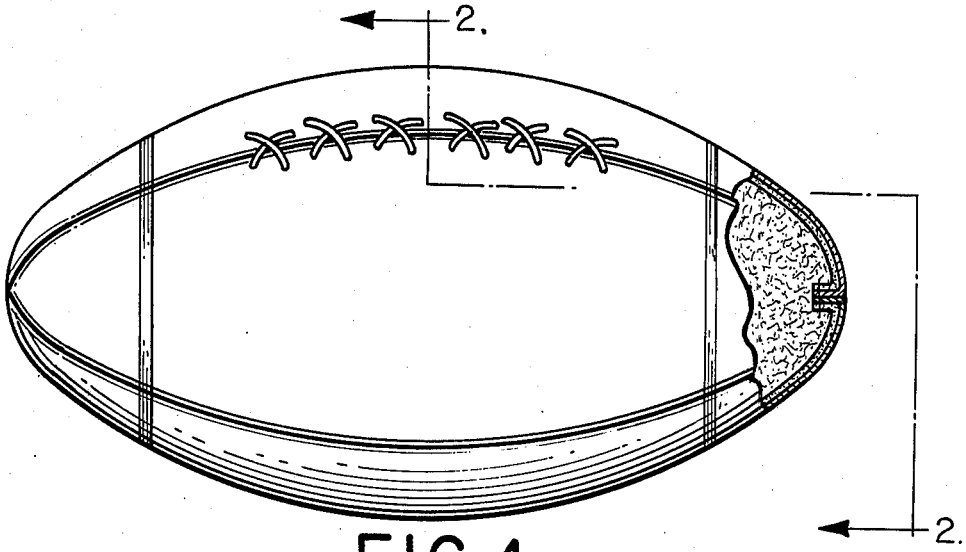
FIG. 1 is a view of the finished ball showing the stitching, the multiple piece cover and a partial cutaway to show the interior polyester batting fill and the wool batting inner cover.
Figure 2:
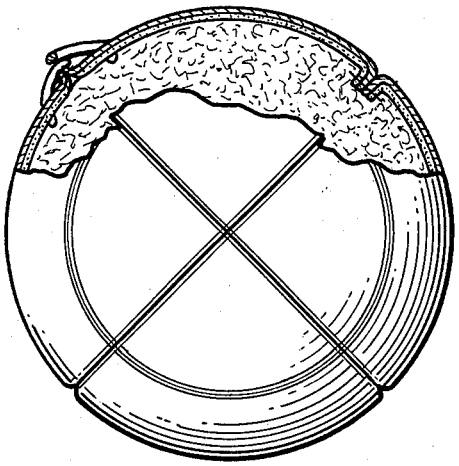
FIG. 2 is a cross sectional line along line 2—2 in FIG. 1 showing the end of the ball and one manner of securing the polyester double-knit cover and the wool batting inner cover.

After the ball has been stuffed with the desired amount of polyester batting fill, the hole in the ball is closed and cross stitches as shown in FIG. 1 are placed on the ball. These can be applied by actual stitching of heavy-duty thread or alternatively by use of a textile paint to produce a raised or elevated ridge for gripping the ball. A combination of actual cross stitching with a heavy thread and textile paint can also be used. This feature enhances the aerodynamic characteristics of the ball by enabling the passer to throw a spiral.

An interlocking stitch is preferably used to close the ball and this area is then raised as previously mentioned to provide a gripping surface for throwing the ball.

To summarize the method of manufacture:

1. The elliptically shaped wool batting inner cover and polyester double-knit outer cover pieces or section are cut out (4 pieces of each).
2. The sections are sewn together along their edges (with the wool batting inner cover on the outside) leaving a small opening—2 or 3 inches—along one seam in the center of the ball.
3. The ball cover is turned right side out and stuffed with the desired amount of polyester batting fill.
4. The opening through which the fill was inserted is closed.

A cross-stitching pattern and/or a textile paint is applied over the opening to create a raised football lace pattern.

6. Any desired decorative work is applied to the ball.

It is apparent from the foregoing that the present invention provides a new and useful ball and method for making the same for use in the conventional American game of football. The present ball can withstand substantial abuse, can be used by beginning players where the use of a conventional hard football would be potentially dangerous to the players, and can be used where space is limited. Further, the ball of this invention is washable, albeit a substantial drying time is required.

It should be understood that various changes and modifications can be made in the details of the procedure, without departing from the scope and spirit of the invention; and, therefore, the invention is not intended to be limited except as indicated in the amended claims. For example, a basketball can be prepared using the general procedure described above. When a basketball is prepared, preferably 8 substantially identical pieces will be used to make up the cover and inner wool batting covering. Similarly to the procedure outlined above, a hole will be left for stuffing the basketball. However, there is no need for raised or elevated cross stitching to provide the gripping surface for throwing as with the football. And, the hardness and weight of the basketball will, of course, can be determined by increasing or decreasing the amount of polyester batting fill used to stuff the ball.

I claim:

1. A ball comprising:

(a) an interior comprised of from about 3 to about 4 ounces of a polyester batting fill comprised of 100% polyester untreated extruded fiber having a denier of from about 4.5 to 5.0, (b) a 4-piece wool batting interior cover, (c) a 4-piece polyester double-knit outer cover each of which said four pieces of said polyester double-knit outer cover are substantially identical and are secured to each other and to said corresponding interior wool batting piece by stitching and said ball further characterized by an elevated or raised cross stitching area to enable the ball to be thrown in a spiral, said ball having the general appearance, shape and characteristics of a conventional football when thrown or kicked but being softer and lighter.

2. The ball of claim 1 wherein said fill is present in the interior portion in an amount of about three and three-quarter ounces and the denier of said fiber is about 4.75.

3. A spherical ball comprising:

(a) an interior comprised of polyester batting fill comprised of 100% polyester untreated extruded fiber having a denier of from about 4.5 to 5.0, (b) an 8-piece wool batting interior cover, (c) an 8-piece polyester double-knit outer cover each of which eight pieces of said polyester double-knit outer cover are substantially identical and are secured to each other and to said corresponding interior wool batting piece by stitching and said ball is further characterized by having the general shape and appearance of a conventional basketball but being softer light lighter.

* * * * *